US006831395B2

(12) United States Patent
Nishikawa

(10) Patent No.: US 6,831,395 B2
(45) Date of Patent: Dec. 14, 2004

(54) SPARK PLUG

(75) Inventor: Kenichi Nishikawa, Bisai (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 123 days.

(21) Appl. No.: 09/867,758

(22) Filed: May 31, 2001

(65) Prior Publication Data

US 2002/0036450 A1 Mar. 28, 2002

(30) Foreign Application Priority Data

May 31, 2000 (JP) ..... P.2000-163848
Apr. 6, 2001 (JP) ..... P.2001-108550

(51) Int. Cl.[7] ..... H01T 13/00; H01T 13/52
(52) U.S. Cl. ..... 313/118
(58) Field of Search ..... 313/118–130, 131 R, 313/131 A, 132–145; 123/169 EL, 169 R; 445/7

(56) References Cited

U.S. PATENT DOCUMENTS

| | | | | |
|---|---|---|---|---|
| 4,084,976 A | | 4/1978 | Hinton | 106/48 |
| 4,120,733 A | | 10/1978 | Knapp | 106/48 |
| 4,256,497 A | | 3/1981 | Knapp | 106/48 |
| 5,518,968 A | | 5/1996 | Knapp | |
| 5,677,250 A | | 10/1997 | Knapp | 501/14 |
| 5,985,473 A | | 11/1999 | Knapp | |
| 6,274,971 B1 | * | 8/2001 | Sugimoto et al. | 313/143 |
| 6,492,289 B1 | | 12/2002 | Suzuki et al. | |
| 2002/0036451 A1 | * | 3/2002 | Nishikawa et al. | |

FOREIGN PATENT DOCUMENTS

| | | | |
|---|---|---|---|
| EP | 0 959 542 | | 11/1999 |
| JP | 10-236845 | | 9/1998 |
| JP | 11-43351 | | 2/1999 |
| JP | 11-106234 | | 4/1999 |
| JP | 2000-048931 | * | 2/2000 |
| JP | 2000-313681 | | 11/2000 |
| JP | 2001-039733 | | 2/2001 |

* cited by examiner

*Primary Examiner*—Nimeshkumar D. Patel
*Assistant Examiner*—Sharlene Leurig
(74) *Attorney, Agent, or Firm*—Morgan, Lewis & Bockius LLP

(57) ABSTRACT

A spark plug 100 has a glaze layer 2*d* formed on a surface of an alumina based insulator 2 contains 1 mol % or less of a Pb component in terms of PbO. The glaze layer 2*d* comprises 35 to 55 mol % of a Si component in terms of $SiO_2$; 15 to 35 mol % of a B component in terms of $B_2O_3$; 5 to 20 mol % of a Zn component in terms of ZnO; 0.5 to 20 mol % of a Ba component in terms of BaO; and 10 to 15 mol % in total of at least one alkaline metal component of Na, K and Li, in terms of $Na_2O$, $K_2O$ and $Li_2O$, respectively.

8 Claims, 9 Drawing Sheets

SPARK PLUG

BACKGROUND OF THE INVENTION

1. Field of the Invention

This invention relates to a spark plug.

2. Description of the Related Art

A spark plug used for ignition of an internal engine of such as automobiles generally comprises a metal shell to which a ground electrode is fixed, an insulator made of alumina ceramics, and a center electrode which is disposed inside the insulator. The insulator projects from the rear opening of the metal shell in the axial direction. A terminal metal fixture is inserted into the projecting part of the insulator and is connected to the center electrode via a conductive glass seal layer which is formed by a glass sealing procedure or a resistor. A high voltage is applied to the terminal metal fixture to cause a spark over the gap between the ground electrode and the center electrode.

Under some combined conditions, for example, at an increased spark plug temperature and an increased environmental humidity, it may happen that high voltage application fails to cause a spark over the gap but, instead, a discharge called as a flashover occurs between the terminal metal fixture and the metal shell, going around the projecting insulator. Primarily for the purpose of avoiding flashover, most of commonly used spark plugs have a glaze layer on the surface of the insulator. The glaze layer also serves to smoothen the insulator surface thereby preventing contamination and to enhance the chemical or mechanical strength of the insulator.

In the case of the alumina insulator for the spark plug, such a glaze of lead silicate glass has conventionally been used where silicate glass is mixed with a relatively large amount of PbO to lower a softening point. In recent years, however, with a globally increasing concern about environmental conservation, glazes containing Pb have been losing acceptance. In the automobile industry, for instance, where spark plugs find a huge demand, it has been a subject of study to phase out Pb glazes in a future, taking into consideration the adverse influences of waste spark plugs on the environment.

Leadless borosilicate glass- or alkaline borosilicate glass-based glazes have been studied as substitutes for the conventional Pb glazes, but they inevitably have inconveniences such as a high glass viscosity or an insufficient insulation resistance. In particular, since the glazes for spark plugs are used attaching to engines, they are apt to rise in temperature than cases of general insulating porcelains (maximum: about 200° C.). Further, in recent years the voltage applied to spark plugs has been increasing together with advancing performance of engines. For these, the glaze for this use has been required to have insulation performance withstanding severer conditions of use. Practically, for restraining flashover at heightened temperatures, requisite is such a glaze having excellent insulating properties.

In conventional leadless glazes for spark plugs, in order that a melting point is checked from rising by exclusion of a lead component, an alkaline metal component has been compounded. The alkaline metal component is useful for securing fluidity when baking the glaze. But it decreases the insulation resistance of the glaze as increasing of the containing amount, and also has an aspect to easily spoil the anti-flashover, it is desirable that the alkaline metal component has a necessarily least amount.

Accordingly, the conventional leadless glaze is apt to be short in the containing amount of the alkaline metal component, and the glass viscosity easily becomes high at high temperatures (when the glaze melts) in comparison with a Pb glaze, and after baking the glaze, pinholes or glaze crimping appear in an external appearance.

SUMMARY OF THE INVENTION

It is an object of the invention to provide such a spark plug having a glaze layer which has a reduced Pb content, is low in the glass viscosity at high temperatures, and exhibits high insulation properties.

Figure 1:
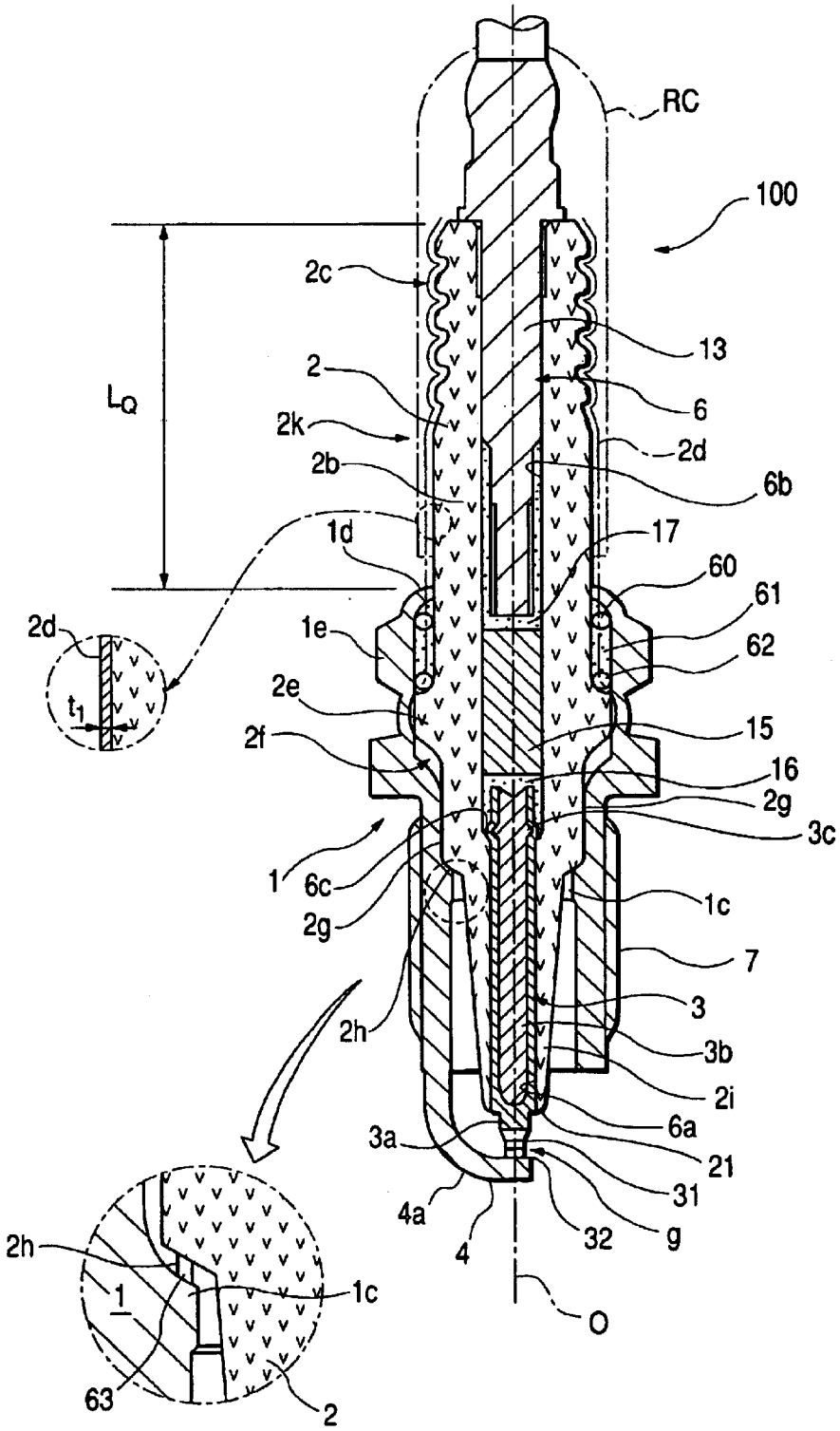
FIG. 1 is a whole front and cross sectional view showing the spark plug according to the invention.

The reference numerals and sign used in the drawings are set forth below.

1: Metal shell;

2: Insulator;

2*d*: Glaze layer;

2*d*': Blaze slurry coated layer;

3: Center electrode;

4: Ground electrode; and

5: Glaze slurry

DETAILED DESCRIPTION OF THE INVENTION

The spark plug according to the invention comprises an alumina based ceramic insulator disposed between a center electrode and a metal shell, where at least part of the surface of the insulator is covered with a glaze layer comprising oxides, and is characterized in that the glaze layer comprises 1 mol % or less of a Pb component in terms of PbO; 35 to 55 mol % of a Si component in terms of $SiO_2$; 15 to 35 mol % of a B component in terms of $B_2O_3$; 5 to 20 mol % of a Zn component in terms of ZnO; 0.5 to 20 mol % of Ba and/or Sr components in terms of BaO or SrO; and 5 to 10 mol % in total of at least one alkaline metal components of Na, K, and Li in terms of $Na_2O$, $K_2O$, and $Li_2$, respectively.

For aiming at the adaptability to the environmental problems, it is a premise that the glaze to be used contains 1.0 mol % or less of the Pb component in terms of PbO (hereafter called the glaze containing the Pb component reduced to this level as "leadless glaze"). When the Pb component is present in the glaze in the form of an ion of lower valency (e.g., $Pb^{2+}$), it is oxidized to an ion of higher valency (e.g., $Pb^{3+}$) by a corona discharge. If this happens, the insulating properties of the glaze layer are reduced, which probably spoils an anti-flashover. From this viewpoint, too, the limited Pb content is beneficial. A preferred Pb content is 0.1 mol % or less. It is most preferred for the glaze to contain substantially no Pb (except a trace amount of lead unavoidably incorporated from raw materials of the glaze).

While reducing the Pb content, the glaze used in the invention has a specifically designed composition for securing the insulating properties, optimizing the glaze baking temperature, and improving the finish of the baked glaze face.

In the conventional glazes, the Pb component plays the important role as to the fluidity when baking the glaze, but in the leadless glaze of the invention, while containing the alkaline metal component for securing the fluidity when baking the glaze, the high insulating resistance can be provided by determining the containing range of the Si component as above mentioned. That is, the alkaline metal component in the glaze lowers the softening point of the glaze and serves to secure the fluidity when baking the glaze. Containing the alkaline metal component in the above mentioned range results the glaze layer which is unlikely to generate pinholes or glaze crimping in an outer appearance.

If the content of the alkaline metal component is less than the above mentioned range, the fluidity when baking the glaze is probably decreased. However, if selecting the total containing amount as above mentioned of the alkaline metal component, it is assumed that such a glaze layer may be provided which is uniform in thickness and is unlikely to cause glaze crimping or pinholes in the appearance owing to air bubbles involved as glaze slurry. If the total containing amount of the alkaline metal component is less than 10 mol %, the softening point of the glaze goes up, the baking of the glaze might be impossible.

Being more than 15 mol %, the insulating property goes down, and the anti-flashover is probably spoiled. Desirably the alkaline metal component is 10 to 12.5 mol %.

Of the alkaline components of Na, K and Li, it is desirable to determine the rate of the K component in mol % in terms of oxide to be $0.4 \leqq K/(Na+K+Li) \leqq 0.8$. Thereby, the glass viscosity is reduced, and in turn while a smoothness of the glaze layer to be formed is heightened, the insulating property is more heightened. The reason therefor will be assumed that since the K component has a larger atomic weight than other alkaline metal components of Na and Li, though being the same mol amount and the same cation number, it occupies the weight ratio owing to the large atomic amount. But it the value of K/(Na+K+Li) is less than 0.4, this effect is probably insufficient.

On the other hand, a reason for the value of K/(Na+K+Li) to be 0.8 or less is for securing the fluidity when baking the glaze, which means that the other alkaline metal components than K is added in joint in a range of the rest balance being 0.2 or more (0 6 or less). With respect to the alkaline metal components, not depending on one kind, but adding in joint two kinds or more selected from Na, K and Li, the insulating property of the glaze layer is more effectively restrained from lowering. As a result, the amount of the alkaline metal components can be increased without decreasing the insulating property, consequently it is possible to concurrently attain the two purposes of securing the fluidity when baking the glaze and the anti-flashover. It is more preferable that the value of K/(Na+K+Li) is adjusted to be 0.5 to 0.7.

Further, in the alkaline metal components, preferably the Li component is contained if feasible for exhibiting the joint-addition of alkaline components so as to improve the insulating property, adjusting the thermal expansion coefficient of the glaze layer, securing the fluidity when baking the glaze, and heightening mechanical strength.

It is desirable that the Li component in mol % in terms of the oxide to be determined to be $$0.2 \leqq Li/(Na+K+Li) \leqq 0.5.$$

If Li is less than 0.2, the thermal expansion coefficient is too large in comparison with that of the substrate alumina, and consequently defects such as crazing easily occur, so that it might be insufficient to secure a finish of the baked glaze surface. In contrast, if Li is more than 0.5, as an Li ion is relatively high in mobility among the alkaline metal ions, bad influences are probably given to the insulating property. It is better that values of Li/(Na+K+Li) are desirably adjusted to range 0.3 to 0.45. For more heightening the insulating property by the joint addition of the alkaline metal components, it is possible to mix other alkaline metal components following the third component as Na in a range where the electric conductivity is not spoiled by excessive joint-addition of the total amount of the alkaline metal components. In particular desirably, it is good to contain all the three components of Na, K and Li.

If selecting the containing range of the Si component as above mentioned, while selecting the total containing amount of the alkaline metal components as described above, it is possible to provide the glaze having the high insulating properties. That is, if determining the above mentioned containing amount of the Si component, while containing the alkaline metal component as said above, a sufficient insulating performance can be secured, thereby to lowering the glass viscosity of the glaze. The alkaline metal component has an inherent high ion conductivity, and acts to decrease the insulation. On the other hand, the Si or B components form a glass skeleton, and if appropriately determining the amounts thereof, the skeleton has a mesh convenient for blocking the ion conductivity of the alkaline metal, and an excellent insulating performance can be provided. As the Si or B components easily form the skeleton, they act to reduce the fluidity when baking the glaze, but if containing the alkaline metal component in the above mentioned range, the fluidity when baking the glaze is increased by lowering of the melting point owing to eutectic reaction and avoidance of complex anion owing to interaction of S ion and O ion. If the Si component is less than 35 mol %, it is difficult to provide the sufficient insulating performance. Being more than 55 mol %, the baking of the glaze is difficult. Thus, the Si component is desirably determined to be 35 to 45 mol %.

Reference will be made in detail to critical meanings of containing ranges of other components of the glaze layer of the invention. If the B containing amount is less than 15 mol %, the softening point of the glaze goes up, and the baking of the glaze will be difficult. On the other hand, being more than 35 mol %, a glaze crimping is easily caused. Depending on containing amounts of other components, such apprehensions might occur as a devitrification of the glaze layer, the lowering of the insulating property, or inconsequence of the thermal expansion coefficient in relation with the substrate. It is good to determine the B containing amount to range 25 to 35 mol % if possible.

If the Zn containing amount is less than 5 mol %, the thermal expansion coefficient of the glaze layer is too large, defects such as crazing are easily occur in the glaze layer. As the Zn component acts to lower the softening point of the glaze, if it is short, the baking of the glaze will be difficult. Being more than 20 mol %, opacity easily occurs in the glaze layer due to the devitrification. It is good that the Zn containing amount to determine 7 to 15 mol %.

The Ba and Sr components contribute to heightening of the insulating property of the glaze layer and are effective to increasing of the strength. If the total amount is less than 0.5 mol %, the insulating property of the glaze layer goes down, and the anti-flashover might be spoiled. Being more than 20 mol %, the thermal expansion coefficient of the glaze layer is too high, defects such as crazing easily occur in the glaze layer. In addition, the opacity easily occurs in the glaze layer. From the viewpoint of heightening the insulating property and adjusting the thermal expansion coefficient, the total amount of Ba and Sr is desirably determined to be 0.5 to 10 mol %. Either or both of the Ba and Sr components may be contained, but the Ba component is advantageously cheaper in a cost of a raw material.

The Ba and Sr components may exist in forms other than oxides in the glaze depending on raw materials to be used. For example, $BaSO_4$ is used as a source of the Ba component, an S component might be residual in the glaze layer. This sulfur component is concentrated nearly to the surface of the glaze layer when baking the glaze to lower the surface expansion of a melted glaze and to heighten a smoothness of a glaze layer to be obtained.

The total amount of the Zn and Ba and/or Sr components which are the main components of the glaze layer of the invention, is desirably 8 to 30 mol % in terms of the above mentioned oxides. Being more than 30 mol %, the opacity will occur in the glaze layer. For example, the visual information such as letters, figures or product numbers are printed with color glazes on external appearances of the insulators for specifying producers and others, it might be difficult to read out the printed visual information owing to such as the opacity. Being less than 8 mol %, the softening point extremely goes up, the glaze baking is difficult and a bad external appearance is caused. Preferably, the total amount is 10 to 20 mol %.

The one or two kinds or more of the Al component of 1 to 10 mol % in terms of $Al_2O_3$, the Ca component of 1 to 10 mol % in terms of CaO, and the Mg component of 0.1 to 10 mol % in terms of MgO may be contained 1 to 15 mol % in total. The Al component is effective to restraining the devitrification, while the Ca and Mg components contribute to heightening of the insulating property of the glaze layer. If the addition amount is less than each of the lower limits, the effect is insufficient, and if being more than the upper limit of each component or more than the upper limit of the total amount, it is difficult or impossible to bake the glaze by the extreme increase of the softening point of the glaze layer. In particular, the Ca component is next to the Ba or Zn components to be useful for improving the insulating property of the glaze layer. In the viewpoint of the thermal expansion coefficient, it is preferable that in case B is in terms of $B_2O_3$ and Zn is in terms of ZnO, the total mol containing amount is $N(B_2O_3+ZnO)$ , and in case the alkaline earth metal component RE (RE is one or two kinds or more selected from Ba, Mg, Ca and Sr) is in terms of composition formula of REO and the alkaline metal component R (R is one or two kinds or more selected from Na, K and Li) is in terms of composition formula of $R_2O$, the total mol containing amount is $N(REO+R_2O)$, and preferable is to be $$1.5 \leqq N(B_2O_3+ZnO)/N(REO+R_2O) \leqq 3.0.$$

This denotes that $B_2O_3$ and ZnO act to decrease the thermal expansion coefficient, while the alkaline earth metal oxide REO and the alkaline metal oxide $R_2O$ act to increase the thermal expansion coefficient, so that it is possible to agree to the thermal expansion coefficient in relation with the substrate of alumina. As a result, the glaze layer can be prevented from appearances of defects such as crazing, cracking or peeling. If the above ranges are less than 1.5, the thermal expansion coefficient is too large in comparison with that of the substrate alumina, and consequently defects such as crazing easily occur, so that it might be insufficient to secure the finish of the baked glaze surface. In contrast, being more than 3.0, the thermal expansion coefficient is too small in comparison with that of the substrate alumina, resulting in easily causing cracking, peeling or crimping in the glaze layer. For making these effects more remarkable, preferable is to be $$1.7 \leqq N(B_2O_3+ZnO)/N(REO+R_2O) \leqq 2.5.$$

The glaze layer can be added with one or two kinds or more of Mo, W, Fe, Ni, Co, and Mn of 0.1 to 5 mol % in terms of $MoO_3$, $WO_3$, FeO, $Ni_3O_4$, $CO_3O_4$, and $MnO_Z$. With these components, it is possible to more easily realize the glazed layer having the baked glaze face enabling to secure the fluidity when baking the glaze, to bake at relatively low temperatures, and having the baked smooth face. As an Fe component source in the raw materials of the glaze, each of Fe(II) ion- (e.g., FeO) and Fe(III) ion-sources (e.g., $Fe_2O_3$) can be employed, and the amount of the final Fe component in the glaze is to be shown with values in terms of $Fe_2O_3$, irrespective of the number of Fe ion.

If the total amount in terms of oxides of one or two kinds or more of Mo, W, Ni, Co, Fe and Mn (called as "fluidity improving transition metal component" hereafter) is less than 0.5 mol %, there will be probably a case of not always providing an effect of improving the fluidity when baking the glaze for easily obtaining a smooth glaze layer. On the other hand, if exceeding 5 mol %, there will be probably a case of being difficult or impossible to bake the glaze owing to too much heightening of the softening point of the glaze.

As a problem when the containing amount of the fluidity improving transition metal component is excessive, such a case may be taken up that not intentioned coloring appears in the glaze layer. For example, visual information such as letters, figures or product numbers are printed with color glazes on external appearances of the insulators for specifying producers and others, and if the colors of the glaze layer is too thick, it might be difficult to readout the printed visual information. As another realistic problem, there is a case that tint changing resulted from alternation in the glaze composition is seen to purchasers as "unreasonable alternation in familiar colors in external appearance", so that an inconvenience occurs that products could not always be quickly accepted because of a resistant feeling thereto.

That the effect of improving the fluidity when baking the glaze is especially remarkable is exhibited by W next to Mo and Fe. For example, it is possible that all the essential transition metal components are made Mo, Fe or W. For more heightening the effect of improving the fluidity when baking the glaze, it is preferable that Mo is 50 mol % or more of the essential transition metals.

The glaze layer can be added with one or two kinds or more of Zr, Ti, Mg, Bi, Sn, Sb and P of 0.5 to 5 mol % in terms of $ZrO_2$, $TiO_2$, MgO, $Bi_2O_3$, $SnO_2$, $Sb_2O_5$, and $P_2O_5$. These components may be positively added in response to purposes or often inevitably included as raw materials of the glaze (otherwise later mentioned clay minerals to be mixed when preparing a glaze slurry) or impurities (otherwise contaminants) from refractory materials in the melting procedure for producing glaze frit. These components way be added appropriately for adjusting the softening point of the glaze (e.g., $Bi_2O_3$, $ZrO_2$, $TiO_2$), heightening the insulating properties (e.g., $ZrO_2$, MgO), or adjusting tints. In particular, the Bi component is less to spoil the insulating properties of the glaze, and is effective for enough adjusting the softening point. By addition of Ti, Zr or Hf, a water resistance is improved. As to the Zr or Hf components, the improved effect of the water resistance of the glaze layer is more noticeable. By the way, "the water resistance is good" is meant that if, for example, a powder like raw material of the glaze is mixed together with a solvent as water and is left as a glaze slurry for a long time, such inconvenience is difficult to occur as increasing a viscosity of the glaze slurry owing to elusion of the component. As a result, in case of coating the glaze slurry to the insulator, optimization of a coating thickness is easy and unevenness in thickness is reduced. Subsequently, said optimization and said reduction can be effectively attained. In addition, Sb has an effect to suppress bubble formation in the glaze layer.

In the composition of the spark plug of the invention, the respective components in the glaze are contained in the forms of oxides, and owing to factors forming amorphous and vitreous phases, existing forms as oxides cannot be often identified. In such cases, if the containing amounts of components at values in terms of oxides fall in the above mentioned ranges, it is regarded that they belong to the ranges of the invention.

The containing amounts of the respective components in the glaze layer formed on the insulator can be identified by use of known micro-analyzing methods such as EPMA (electronic probe micro-analysis) or XFS (X-ray photoelectron spectroscopy). For example, if using EPMA, either of a wavelength dispersion system and an energy dispersion system is sufficient for measuring characteristic X-ray. Further, there is a method where the glaze layer is peeled from the insulator and is subjected to a chemical analysis or a gas analysis for identifying the composition.

The spark plug having the glaze layer of the invention may be composed by furnishing, in a through-out hole of the insulator, an axially shaped terminal metal fixture as one body with the center electrode or holding a conductive binding layer in relation therewith, said metal fixture being separate from a center electrode. In this case, the whole of the spark plug is kept at around 500° C., and an electric conductivity is made between the terminal metal fixture and a metal shell via the insulator, enabling to measure the insulating resistant value. For securing an insulating endurance at high temperatures, it is desirable that the insulating resistant value is secured 200 MΩ or higher so as to prevent the flashover.

Figure 6:
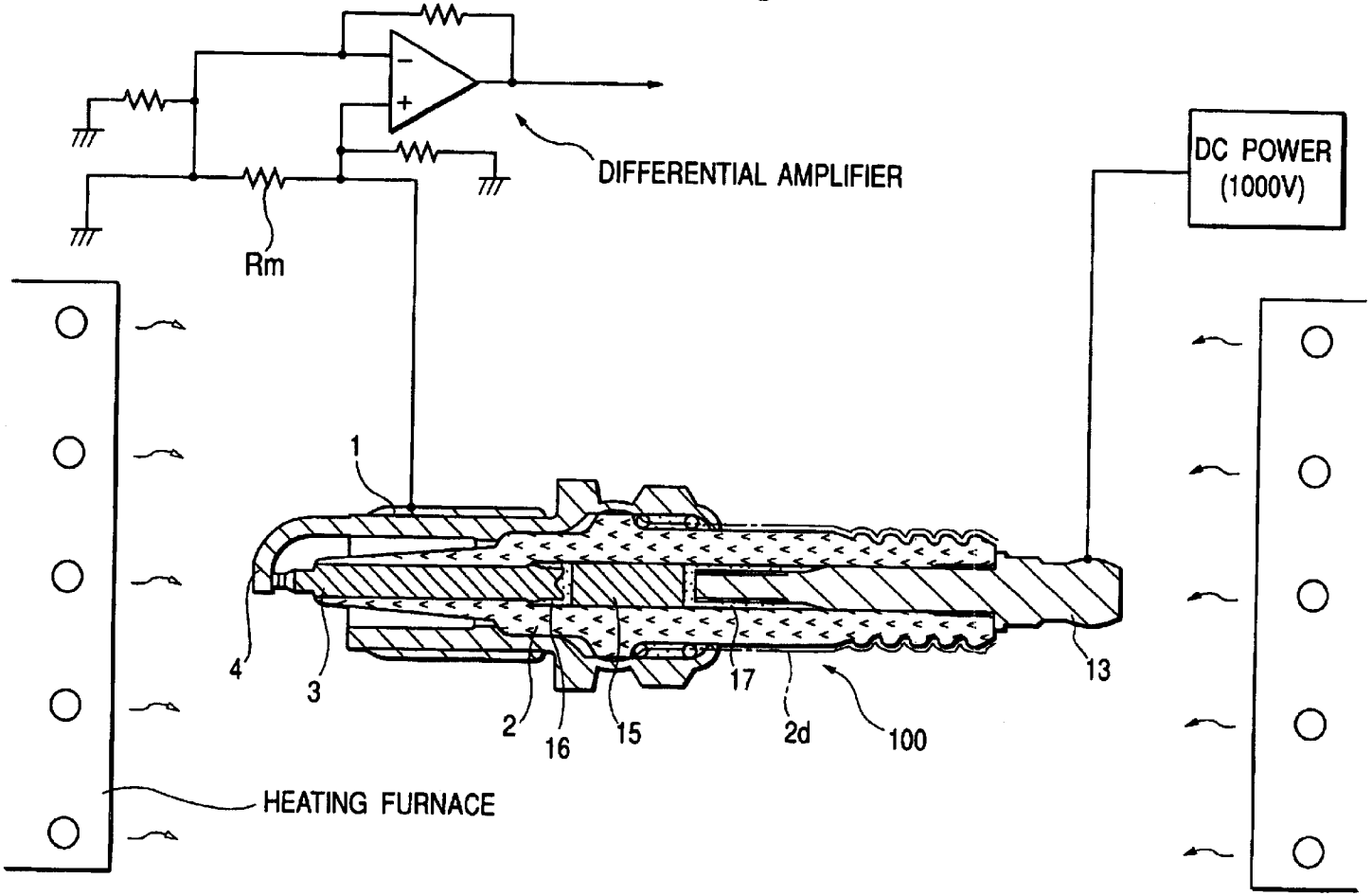
FIG. 6 is an explanatory view showing the measuring method of the insulation resistant value of the spark plug.

FIG. 6 shows one example of measuring system. That is, DC constant voltage source (e.g., source voltage 1000 V) is connected to the side of a terminal metal 13 of the spark plug 100, while at the same time, the side of the metal shell 1 is grounded, and a current is passed under a condition where the spark plug 100 disposed in a heating oven is heated at 500° C. For example, imagining that a current value Im is measured by use of a current measuring resistance (resistance value Rm) at the voltage VS, an insulation resistance value Rx to be measured can be obtained as (VS/Im)−Rm (in the drawing, the current value Im is measured by output of a differential amplifier for amplifying voltage difference at both ends of the current measuring resistance).

The insulator may comprise the alumina insulating material containing the Al component 85 to 98 mol % in terms of $Al_2O_3$. Preferably, the glaze has an average thermal expansion coefficient of $50\times10^{-7}$/° C. to $85\times10^{-7}$/° C. at the temperature ranging 20 to 350° C. Being less than this lower limit, defects such as cracking or graze skipping easily happen in the graze layer. On the other hand, being more than the upper limit, defects such as crazing are easy to happen in the graze layer. The thermal expansion coefficient more preferably ranges $60\times10^{-7}$/° C. to $80\times10^{-7}$/° C.

The thermal expansion coefficient of the glaze layer is assumed in such ways that samples are cut out from a vitreous glaze bulk body prepared by mixing and melting raw materials such that almost the same composition as the glaze layer is realized, and values measured by a known dilatometer method. The thermal expansion coefficient of the glaze layer on the insulator can be measured by use of, e.g., a laser inter-ferometer or an interatomic force microscope, The insulator is formed with a projection part in an outer circumferential direction at an axially central position thereof. Taking, as a front side, a side directing toward the front end of the center electrode in the axial direction, a cylindrical face is shaped in the outer circumferential face at the base portion of the insulator main body in the neighborhood of a rear side opposite the projection part. In this case, the outer circumferential face at the base portion is covered with the glaze layer formed with the film thickness ranging 7 to 50 μm.

In automobile engines, such a practice is broadly adopted that the spark plug is attached to engine electric equipment system by means of rubber caps, and for heightening the anti-flashover, important is the adherence between the insulator and the inside of the rubber cap. The inventors made earnest studies and found that, in the leadless glaze of borosilicate glass or alkaline borosilicate, it is important to adjust thickness of the glaze layer for obtaining a smooth surface of the baked glaze, and as the outer circumference of the base portion of the insulator main body particularly requires the adherence with the rubber cap, unless appropriate adjustment is made to the film thickness, a sufficient anti-flashover cannot be secured. Therefore, in the insulator having the leadless glaze layer of the above mentioned composition of the spark plug according to the third invention, if the film thickness of the glaze layer covering the outer circumference of the base portion of the insulator is set in the range of the above numerical values, the adherence with the baked glaze face and the rubber cap may be heightened, and in turn the anti-flashover may be improved without lowering the insulating property of the glaze layer.

If the thickness of the glaze layer at said base portion of the insulator is less than 7 μm, the leadless glaze of the above mentioned composition is difficult to form the smooth baked surface, so that the adherence with the baked glaze face and the rubber cap is spoiled and the anti-flashover is made insufficient. But if the thickness of the glaze layer is more than 50 μm, a cross sectional area of the electric conductivity increases, the leadless glaze of the above mentioned composition is difficult to secure the insulating property, probably resulting in lowering of the anti-flashover.

The spark plug of the invention can be produced by a production method comprising a step of preparing glaze powders in which the raw material powders are mixed at a predetermined ratio, the mixture is heated 1000 to 1500° C. and melted, the melted material is rapidly cooled, vitrified and ground into powder;

a step of piling the glaze powder on the surface of an insulator to form a glaze powder layer; and a step of heating the insulator, thereby to bake the glaze powder layer on the surface of the insulator.

The powdered raw material of each component includes not only an oxide thereof (sufficient with complex oxide) but also other inorganic materials such as hydroxide, carbonate, chloride, sulfate, nitrate, or phosphate. These inorganic materials should be those of capable of being converted to corresponding oxides by heating and melting. The rapidly cooling can be carried out by throwing the melt into a water or atomizing the melt onto the surface of a cooling roll for obtaining flakes.

The glaze powder is dispersed into the water or solvent, so that it can be used as a glaze slurry. For example, if coating the glaze slurry onto the insulator surface to dry it, the piled layer of the glaze powder can be formed as a coated layer of the glaze slurry. By the way, as the method of coating the glaze slurry on the insulator surface, if adopting a method of spraying from an atomizing nozzle onto the insulator surface, the piled layer in uniform thickness of the glaze powder can be easily formed and an adjustment of the coated thickness is easy.

The glaze slurry can contain an adequate amount of a clay mineral or an organic binder for heightening a shape retention of the piled layer of the glaze powder. As the clay mineral, those composed of mainly aluminosolicate hydrates can be applied, for example, those composed of mainly one or two kinds or more of allophane, imogolite, hisingerite, smectite, kaolinite, halloysite, montmorillonite, vermiculite, and dolomite (or mixtures thereof) can be used. In relation with the oxide components, in addition to $SiO_2$ and $Al_2O_3$, those mainly containing one or two kinds or more of $Fe_2O_3$, $TiO_2$, CaO, MgO, $Na_2O$ and $K_2O$ can be used.

The spark plug of the invention is constructed of an insulator having a through-hole formed in the axial direction thereof, a terminal metal fixture fitted in one end of the through-hole, and a center electrode fitted in the other end. The terminal metal fixture and the center electrode are electrically connected via an electrically conductive sintered body mainly comprising a mixture of a glass and a conductive material (e.g., a conductive glass seal or a resistor). The spark plug having such a structure can be made by a process including the following steps.

An assembly step: a step of assembling a structure comprising the insulator having the through-hole, the terminal metal fixture fitted in one end of the through-hole, the center electrode fitted in the other end, and a filled layer formed between the terminal metal fixture and the center electrode, which filled layer comprises the glass powder and the conductive material powder.

A glaze baking step: a step of heating the assembled structure formed with the piled layer of the glaze powder on the surface of the insulator at temperature ranging 800 to 950° C. to bake the piled layer of the glaze powder on the surface of the insulator so as to form a glaze layer, and at the same time softening the glass powder in the filled layer.

A pressing step: a step of bringing the center electrode and the terminal metal fixture relatively close within the through-hole, thereby pressing the filled layer between the center electrode and the terminal metal fixture into the electrically conductive sintered body, In this case, the terminal metal fixture and the center electrode are electrically connected by the electrically conductive sintered body to concurrently seal the gap between the inside of the through-hole and the terminal metal fixture and the center electrode. Therefore, the glaze baking step also serves as a glass sealing step. This process is efficient in that the glass sealing and the glaze baking are performed simultaneously. Since the above mentioned glaze allows the baking temperature to be lower to 800 to 950° C., the center electrode and the terminal metal fixture hardly suffer from bad production owing to oxidation so that the yield of the spark plug is heightened. It is also sufficient that the baking glaze step is preceded to the glass sealing step.

The softening point of the glaze layer is preferably adjusted to range, e.g., 600 to 700° C. When the softening point is higher than 700° C., the baking temperature above 950° C. will be required to carry out both baking and glass sealing, which may accelerate oxidation of the center electrode and the terminal metal fixture. When the softening point is lower than 600° C., the glaze baking temperature should be set lower than 800° C. In this case, the glass used in the conductive sintered body must have a low softening point in order to secure a satisfactory glass seal. As a result, when an accomplished spark plug is used for a long time in a relatively high temperature environment, the glass in the conductive sintered body is liable to denaturalization, and where, for example, the conductive sintered body comprises a resistor, the denaturalization of the glass tends to result in deterioration of the performance such as a life under load.

The softening point of the glaze layer is a value measured by performing a differential thermal analysis on the glaze layer peeled off from the insulator and heated, and it is obtained as a temperature of a peak appearing next to a first endothermic peak (that is, the second endothermic peak) which is indicative of a sag point. The softening point of the glaze layer formed in the surface of the insulator can be also estimated from a value obtained with a glass sample which is prepared by compounding raw materials so as to give substantially the same composition as the glaze layer under analysis, melting the composition and rapidly cooling.

Mode for carrying out the invention will be explained with reference to the accompanying drawings.

FIG. 1 shows an example of the spark plug of the first structure according to the invention. The spark plug 100 has a cylindrical metal shell 1, an insulator 2 fitted in the inside of the metal shell 1 with its tip 21 projecting from the front end of the metal shell 1, a center electrode 3 disposed inside the insulator 2 with its ignition part 31 formed at the tip thereof, and a ground electrode 4 with its one end welded to the metal shell 1 and the other end bent inward such that a side of this end may face the tip of the center electrode 3. The ground electrode 4 has an ignition part 32 which faces the ignition part 31 to make a spark gap g between the facing ignition parts.

The metal shell 1 is formed to be cylindrical of such as a low carbon steel. It has a thread 7 there around for screwing the spark plug 100 into an engine block (not shown). Symbol 1*e* is a hexagonal nut portion over which a tool such as a spanner or wrench fits to fasten the metal shell 1.

The insulator 2 has a through-hole 6 penetrating in the axial direction. A terminal fixture 13 is fixed in one end of the through-hole 6, and the center electrode 3 is fixed in the other end. A resistor 15 is disposed in the through-hole 6 between the terminal metal fixture 13 and the center electrode 3. The resistor 15 is connected at both ends thereof to the center electrode 3 and the terminal metal fixture 13 via the conductive glass seal layers 16 and 17, respectively. The resistor 15 and the conductive glass seal layers 16, 17 constitute the conductive sintered body. The resistor 15 is formed by heating and pressing a mixed powder of the glass powder and the conductive material powder (and, if desired, ceramic powder other than the glass) in a later mentioned glass sealing step. The resistor 15 may be omitted, and the terminal metal fixture 13 and the center electrode 3 may be directly connected by one seal layer of the conductive glass seal.

The insulator 2 has the through-hole 6 in its axial direction for fitting the center electrode 3, and is formed as a whole with an insulating material as follows. That is, the insulating material comprises an alumina ceramic sintered body having an Al content of 85 to 98 mol % (preferably 90 to 98 mol %) in terms of $Al_2O_3$.

The specific components other than Al are exemplified as follows.

Si component: 1.50 to 5.00 mol % in terms of $SiO_2$;

Ca component: 1.20 to 4.00 mol % in terms of CaO;

Mg component: 0.05 to 0.17 mol % in terms of MgO;

Ba component: 0.15 to 0.50 mol % in terms of BaO; and

B component: 0.15 to 0.50 mol % in terms of $B_2O_3$.

The insulator 2 has a projection 2*e* projecting outwardly, e.g., flange-like on its periphery at the middle part in the axial direction, a rear portion 2*b* whose outer diameter is smaller than the projecting portion 2*e*, a first front portion 2*g* in front of the projecting portion 2*e*, whose outer diameter is smaller than the projecting portion 2*e*, and a second front portion 2*i* in front of the first front portion 2*g*, whose outer diameter is smaller than the first front portion 2*g*. The rear end part of the rear portion 2*b* has its periphery corrugated to form corrugations 2*c*. The first front portion 2*g* is almost cylindrical, while the second front portion 2*i* is tapered toward the tip 21.

On the other hand, the center electrode 3 has a smaller diameter than that of the resistor 15. The through-hole 6 of the insulator 2 is divided into a first portion 6*a* (front portion) having a circular cross section in which the center electrode 3 is fitted and a second portion 6*b* (rear portion) having a circular cross section with a larger diameter than that of the first portion 6*a*. The terminal metal fixture 13 and the resistor 15 are disposed in the second portion 6*b*, and the center electrode 3 is inserted in the first portion 6*a*. The center electrode 3 has an outward projection 3*c* around its periphery near the rear end thereof, with which it is fixed to the electrode. A first portion 6*a* and a second portion 6*b* of the through-hole 6 are connected each other in the first front portion 2*g* in FIG. 3A, and at the connecting part, a projection receiving face 6*c* is tapered or rounded for receiving the projection 3*c* for fixing the center electrode 3.

The first front portion 2*g* and the second front portion 2*i* of the insulator 2 connect at a connecting part 2*h*, where a level difference is formed on the outer surface of the insulator 2. The metal shell 1 has a projection 1*c* on its inner wall at the position meeting the connecting part 2*h* so that the connecting part 2*h* fits the projection 1*c* via a gasket ring 63 thereby to prevent slipping in the axial direction. A gasket ring 62 is disposed between the inner wall of the metal shell 1 and the outer side of the insulator 2 at the rear of the flange-like projecting portion 2*e*, and a gasket ring 60 is provided in the rear of the gasket ring 62. The space between the two gaskets 60 and 62 is filled with a filler 61 such as talc. The insulator 2 is inserted into the metal shell 1 toward the front end thereof, and under this condition, the rear opening edge of the metal shell 1 is pressed inward the gasket 60 to form a sealing lip 1*d*, and the metal shell 1 is secured to the insulator 2.

Figure 3A:
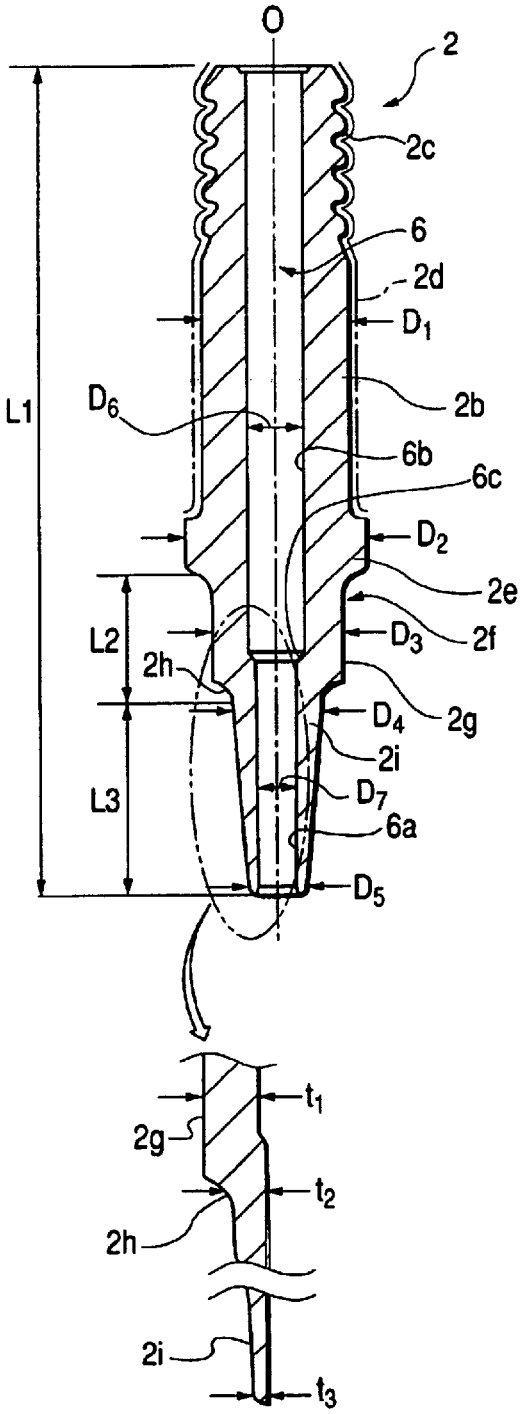
FIGS. 3A and 3B are vertical cross sectional views showing some examples of the insulator.
Figure 3B:
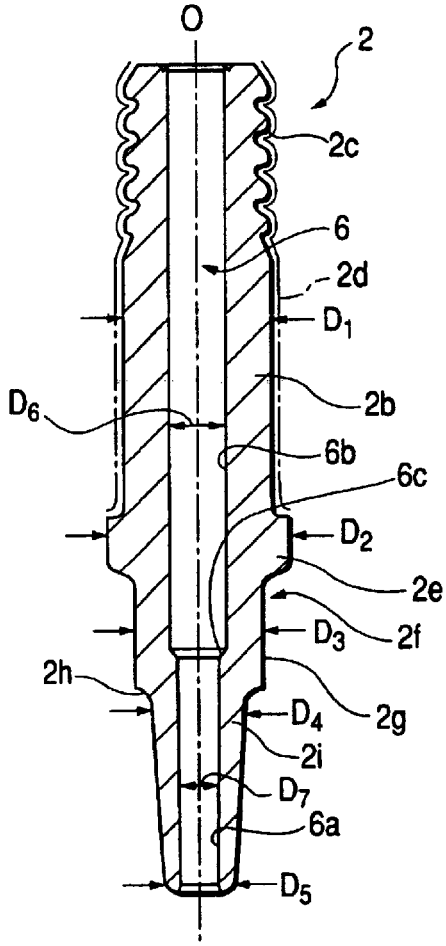

FIGS. 3A and 3B show practical examples of the insulator 2. The ranges of dimensions of these insulators are as follows.

Total length L1: 30 to 75 mm;

Length L2 of the first front portion 2*g;* 0 to 30 mm (exclusive of the connecting part 2*f* to the projecting portion 2*e* and inclusive of the connecting part 2*h* to the second front portion 2*i*);

Length L3 of the second front portion 2*i:* 2 to 27 mm;

Outer diameter D1 of the rear portion 2*b:* 9 to 13 mm;

Outer diameter D2 of the projecting portion 2*e:* 11 to 16 mm;

Outer diameter D3 of the first front portion 2*g;* 5 to 11 mm;

Outer base diameter D4 of the second front portion 2*i:* 3 to 8 mm;

Outer tip diameter D5 of the second front portion 2*i* (where the outer circumference at the tip is rounded or beveled, the outer diameter is measured at the base of the rounded or beveled part in a cross section containing the center axial line O): 2.5 to 7 mm;

Inner diameter D6 of the second portion 6*b* of the through-hole 6: 2 to 5 mm;

Inner diameter D7 of the first portion 6*a* of the through-hole 6; 1 to 3.5 mm;

Thickness t1 of the first front portion 2*g:* 0.5 to 4.5 mm;

Thickness t2 at the base of the second front portion 2*i* (the thickness in the direction perpendicular to the center axial line O): 0.3 to 3.5 mm;

Thickness t3 at the tip of the second front portion 2*i* (the thickness in the direction perpendicular to the center axial line O; where the outer circumference at the tip is rounded or beveled, the thickness is measured at the base of the rounded or beveled part in a cross section containing the center axial line O): 0.2 to 3 mm; and Average thickness tA ((t2+t3)/2) of the second front portion 2*i:* 0.25 to 3.25 mm.

In FIG. 1, a length LQ of the portion 2*k* of the insulator 2 which projects over the rear end of the metal shell 1, is 23 to 27 mm (e.g., about 25 mm). In a vertical cross section containing the center axial line O of the insulator 2 on the outer contour of the projecting portion 2*k* of the insulator 2, the length LP of the portion 2*k* as measured along the profile of the insulator 2 is 26 to 32 mm (e.g., about 29 mm) starting from a position corresponding to the rear end of the metal shell 1, through the surface of the corrugations 2*c*, to the rear end of the insulator 2.

The insulator 2 shown in FIG. 3A has the following dimensions. L1=ca. 60 mm, L2=ca. 10 mm, L3=ca. 14 mm, D1=ca. 11 mm, D2=ca. 13 mm, D3=ca. 7.3 mm, D4=5.3 mm, D5=4.3 mm, D6=3.9 mm, D7=2.6 mm, t1=3.3 mm, t2=1.4 mm, t3=0.9 mm, and tA=1.15 mm.

The insulator 2 shown in FIG. 3B is designed to have slightly larger outer diameters in its first and second front portions 2*g* and 2*i* than in the example shown in FIG. 3A. It has the following dimensions. L1=ca. 60 mm, L2=ca. 10 mm, L3=ca. 14 mm, D1=ca. 11 mm, D2=ca. 13 mm, D3=ca. 9.2 mm, D4=6.9 mm, D5=5.1 mm, D6=3.9 mm, D7=2.7 mm, t1=3.3 mm, t2=2.1 mm, t3=1.2 mm, and tA=1.65 mm.

Figure 2:
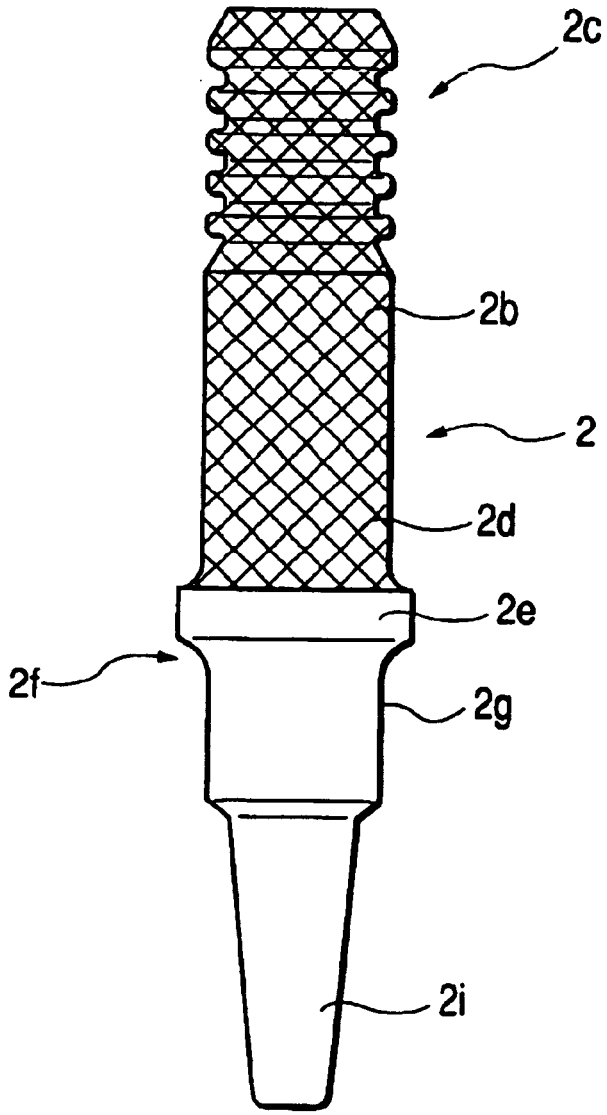
FIG. 2 is a front view showing an external appearance of the insulator together with the glaze layer.

As shown in FIG. 2, the glaze layer 2*d* is formed on the outer surface of the insulator 2, more specifically, on the outer peripheral surface of the rear portion 2*b* inclusive of the corrugated part 2*c*. The glaze layer 2*d* has a thickness of 7 to 150 $\mu$m, preferably 10 to 50 $\mu$m. As shown in FIG. 1, the glaze layer 2*d* formed on the rear portion 2*b* extends in the front direction farther from the rear end of the metal shell 1 to a predetermined length, while the rear side extends till the rear end edge of the rear portion 2*b*.

The glaze layer 2*d* has anyone of the compositions explained in the columns of the means for solving the problems, works and effects. As the critical meaning in the composition range of each component has been referred to in detail, no repetition will be made herein. The thickness tg (average value) of the glaze layer 2*d* on the outer circumference of the base of the rear portion 2*b* (the cylindrical and non-corrugated outer circumference part 2*c* projecting downward from the metal shell 1) is 7 to 50 μm. The corrugations 2*c* may be omitted. In this case, the average thickness of the glaze layer 2*d* on the area from the rear end of the metal shell 1 up to 50% of the projecting length LQ of the main part 1*b* is taken as t1.

The ground electrode 4 and the core 3*a* of the center electrode are made of an Ni alloy. The core 3*a* of the center 3 is buried inside with a core 3*b* comprising Cu or Cu alloy for accelerating heat dissipation. An ignition part 31 and an opposite ignition part 32 are mainly made of a noble metal alloy based on one or two kinds or more of Ir, Pt and Rh. The core 3*a* of the center electrode 3 is reduced in diameter at a front end and is formed to be flat at the front face, to which a disk made of the alloy composing the ignition part is superposed, and the periphery of the joint is welded by a laser welding, electron beam welding, or resistance welding to form a welded part W, thereby constructing the ignition part 31. The opposite ignition part 32 positions a tip to the ground electrode 4 at the position facing the ignition part 31, and the periphery of the joint is welded to form a similar welded part W along an outer edge part. The tips are prepared by a molten metal comprising alloying components at a predetermined ratio or forming and sintering an alloy powder or a mixed powder of metals having a predetermined ratio. At least one of the ignition part 31 and the opposite ignition part 32 may be omitted.

The spark plug 100 can be produced as follows. In preparing the insulator 2, an alumina powder is mixed with raw material powders of a Si component, Ca component, Mg component, Ba component, and B component in such a mixing ratio as to give the aforementioned composition after sintering, and the mixed powder is mixed with a prescribed amount of a binder (e.g., PVA) and a water to prepare a slurry. The raw material powders include, for example, $SiO_2$ powder as the Si component, $CaCO_3$ powder as the Ca component, MgO powder as the Mg component, $BaCO_3$ as the Ba component, and $H_3PO_3$ as to the B component. $H_3BO_3$ may be added in the form of a solution.

A slurry is spray-dried into granules for forming a base, and the base forming granules are rubber-pressed into a pressed body a prototype of the insulator. The formed body is processed on an outer side by grinding to the contour of the insulator 2 shown in FIG. 1, and then baked 1400 to 1600° C. to obtain the insulator 2.

The glaze slurry is prepared as follows.

Raw material powders as sources of Si, B, Zn, Ba, and alkaline components (Na, K, Li) (for example, $SiO_2$ powder for the Si component, $H_3PO_3$ powder for the B component, ZnO powder for the Zn component, $BaCO_3$ powder for the Ba component, $Na_2CO_3$ powder for the Na component, $K_2CO_3$ powder for the K component, and $Li_2CO_3$ powder for the Li component) are mixed for obtaining a predetermined composition. The mixed powder is heated and melted 1000 to 1500° C., and thrown into the water to rapidly cool for vitrification, followed by grinding to prepare a glaze fritz. The glaze fritz is mixed with appropriate amounts of clay mineral, such as kaolin or gairome clay, and organic binder, and the water is added thereto to prepare the glaze slurry.

Figure 7:
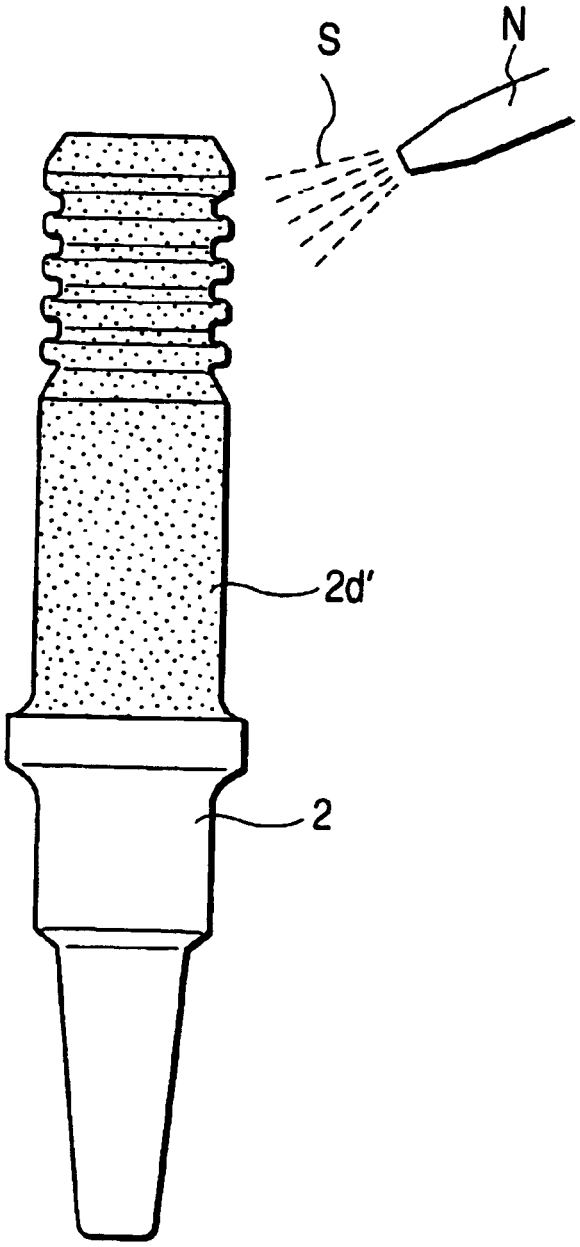
FIG. 7 is an explanatory view of the forming step of coating the slurry of the glaze.

As shown in FIG. 7, the glaze slurry S is sprayed from a nozzle N to coat a requisite surface of the insulator 2, thereby to form a coated layer 2*d*' of the glaze slurry as the piled layer of the glaze powder.

Figure 8D:
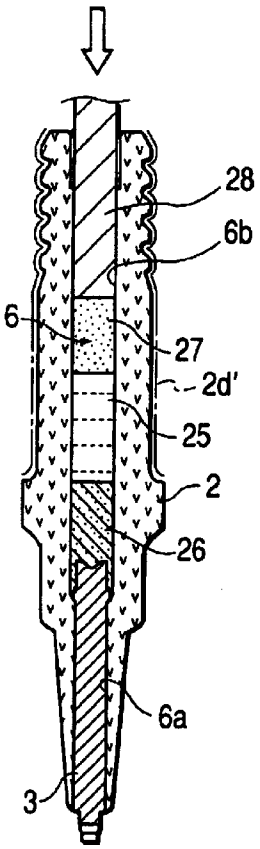
FIGS. 8A to 8D are explanatory views of the gas sealing step.
Figure 8C:
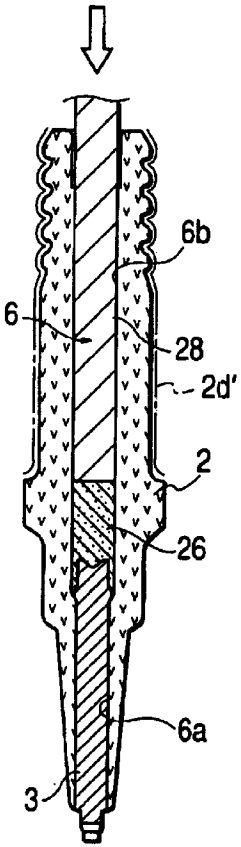
Figure 8B:
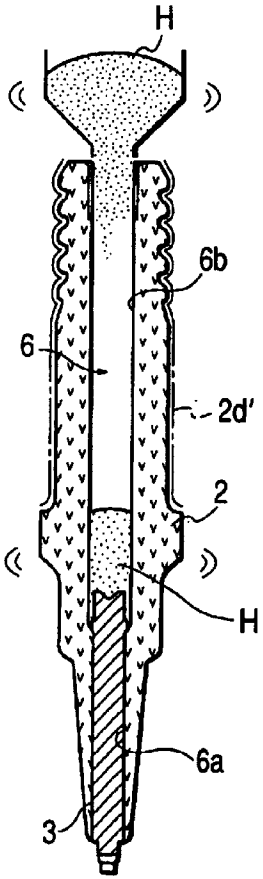
Figure 8A:
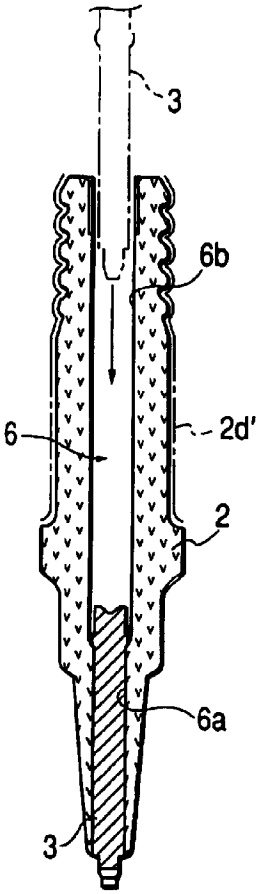

The center electrode 3 and the terminal metal fixture 13 are fitted in the insulator 2 formed with the glaze slurry coated layer 2*d*' as well as the resistor 15 and the electrically conductive glass seal layers 16, 17 are formed as follows. As shown in FIG. 8A, the center electrode 3 is inserted into the first portion 6*a* of the through-hole 6. A conductive glass powder H is filled as shown in FIG. 8B. The powder H is preliminary compressed by pressing a press bar 28 into the through-hole 6 to form a first conductive glass powder layer 26. A raw material powder for a resistor composition is filled and preliminary compressed in the same manner, so that, as shown in FIG. 8D, the first conductive glass powder 26, the resistor composition powder layer 25 and a second conductive glass powder layer 27 are laminated from the center electrode 3 (lower side) into the through-hole 6.

Figure 9A:
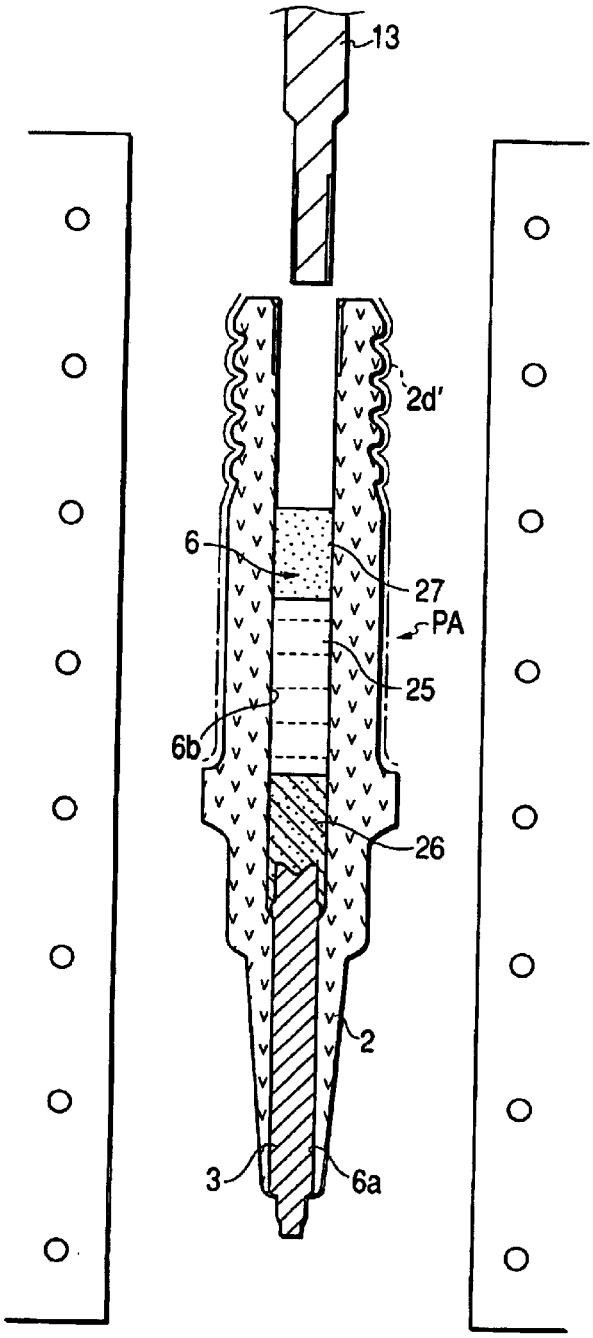
FIGS. 9A and 9B are explanatory views continuing from FIGS. 8A to 8D.

An assembled structure PA is formed where the terminal metal fixture 13 is disposed from the upper part into the through-hole 6 as shown in FIG. 9A. The assembled structure PA is put into a heating oven and heated at a predetermined temperature of 800 to 950° C. being above the glass softening point, and then the terminal metal fixture 13 is pressed into the through-hole 6 from a side opposite to the center electrode 3 so as to press the superposed layers 25 to 27 in the axial direction. Thereby, as seen in FIG. 9B, the layers are each compressed and sintered to become a conductive glass seal layer 16, a resistor 15, and a conductive glass seal layer 17 (the above is the glass sealing step).

Figure 9B:
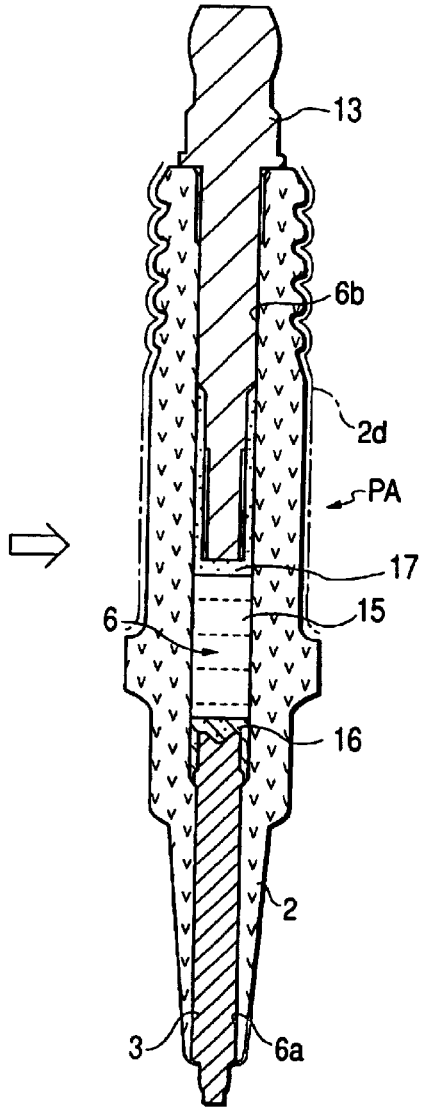

If the softening point of the glaze powder contained in the glaze slurry coated layer 2*d*' is set to be 600 to 700° C., the layer 2*d*' can be baked as shown in FIGS. 9A and 9B, at the same time as the heating in the above glass sealing step, into the glaze layer 2*d*. Since the heating temperature of the glass sealing step is selected from the relatively low temperature of 800 to 950° C., oxidation to surfaces of the center electrode 3 and the terminal metal fixture 13 can be made less.

If a burner type gas furnace is used as the heating oven (which also serves as the glaze baking oven), a heating atmosphere contains relatively much steam as a combustion product. If the glaze composition containing the B component 40 mol % or less is used, the fluidity when baking the glaze can be secured even in such an atmosphere, and it is possible to form the glaze layer of smooth and homogeneous substance and excellent in the insulation.

After the glass sealing step, the metal shell 1, the ground electrode 4 and others are fitted on the structure PA to complete spark plug 100 shown in FIG. 1. The spark plug 100 is screwed into an engine block using the thread 7 thereof and used as a spark source to ignite an air/fuel mixture supplied to a combustion chamber. A high-tension cable or an ignition coil is connected to the spark plug 100 by means of a rubber cap RC (comprising, e.g., silicone rubber). The rubber cap RC has a smaller hole diameter than the outer diameter D1 (FIGS. 3A and 3B) of the rear portion 2*b* by about 0.5 to 1.0 mm. The rear portion 2*b* is pressed into the rubber cap while elastically expanding the hole until it is covered therewith to its base. As a result, the rubber cap RC comes into close contact with the outer surface of the rear portion 2*b* to function as an insulating cover for preventing flashover.

Figure 4:
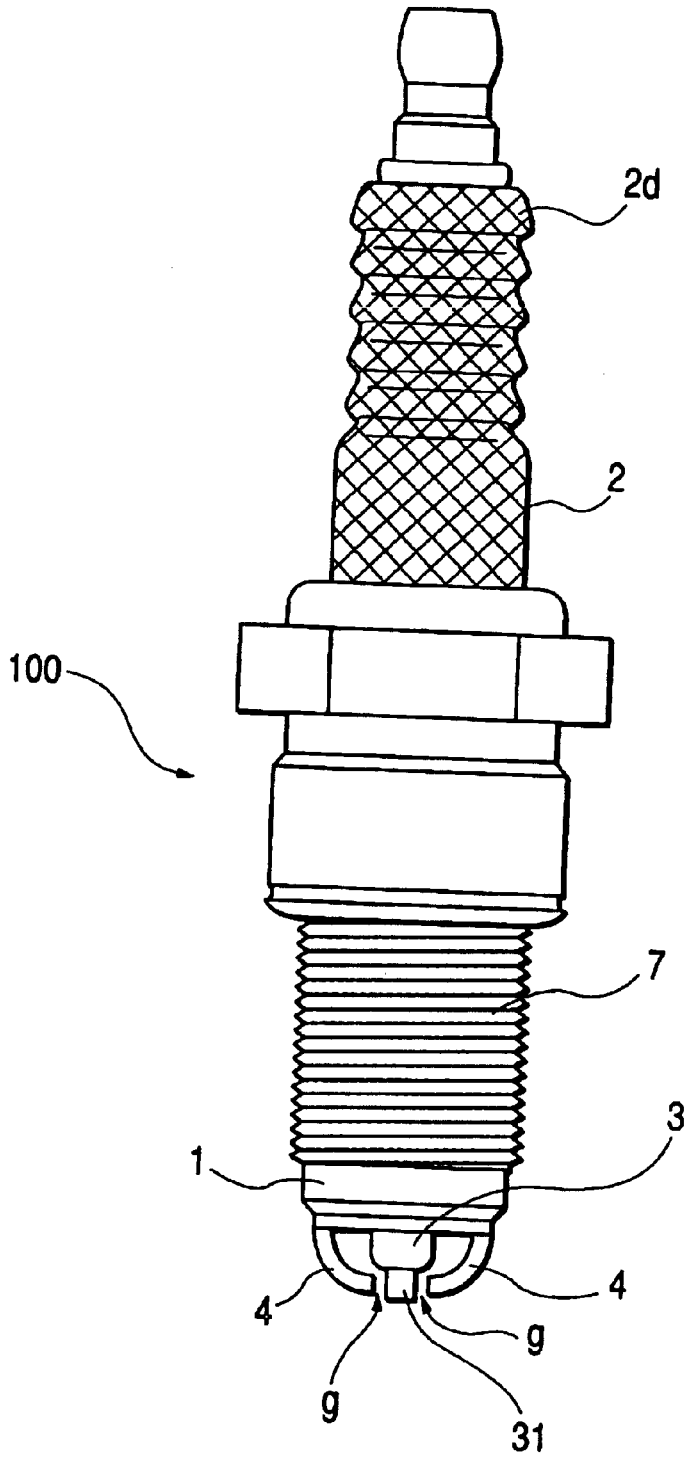
FIG. 4 is a whole front view showing another example of the spark plug according to the invention.
Figure 5:
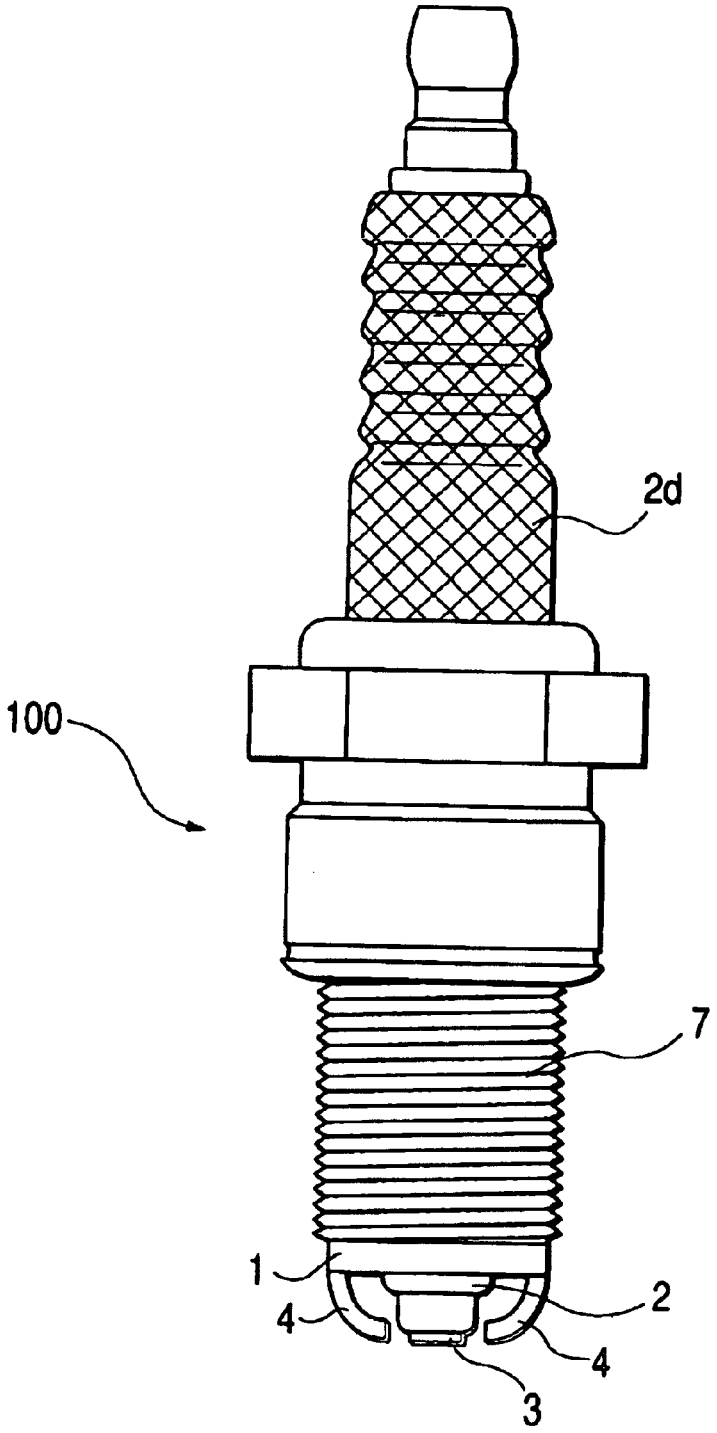
FIG. 5 is a whole front view showing a further example of the spark plug according to the invention.

By the way, the spark plug of the invention is not limited to the type shown in FIG. 1, but for example as shown in FIG. 4, the tip of the ground electrode 4 is made face the side of the center electrode 3 to form an ignition gap g. Further, as shown in FIG. 5, a semi-planar discharge type spark plug is also useful where the front end of the insulator 2 is advanced between the side of the center electrode 3 and the front end of the ground electrode 4.

EXAMPLES

For confirmation of the effects according to the invention, the following experiments were carried out.

Experiment 1

The insulator 2 was made as follows. Alumina powder (alumina content: 95 mol %; Na content (as $Na_2O$): 0.1 mol %; average particle size: 3.0 μm) was mixed at a predetermined mixing ratio with $SiO_2$ (purity: 99.5%; average particle size: 1.5 μm), $CaCO_3$ (purity: 99.9%; average particle size: 2.0 μm), MgO (purity; 99.5%; average particle size: 2 μm) $BaCO_3$ (purity: 99.5%; average particle size: 1.5 μm), $H_3BO_3$ (purity: 99.0%; average particle size 1.5 μm), and ZnO (purity: 99.5%, average particle size: 2.0 μm). To 100 parts by weight of the resulting mixed powder were added 3 parts by weight of PVA as a hydrophilic binder and 103 parts by weight of water, and the mixture was kneaded to prepare a slurry.

The resulting slurry was spray-dried into spherical granules, which were sieved to obtain fraction of 50 to 100 μm. The granules were formed under a pressure of 50 MPa by a known rubber-pressing method. The outer surface of the formed body was machined with the grinder into a predetermined figure and baked at 1550° C. to obtain the insulator 2. The X-ray fluorescence analysis revealed that the insulator 2 had the following composition.

Al component (as $Al_2O_3$): 94.9 mol %;

Si component (as SiO2): 2.4 mol %;

Ca component (as CaO): 1.9 mol %;

Mg component (as MgO): 0.1 mol %:

Ba component (as BaO): 0.4 mol %; and

B component (as $B_2O_3$): 0.3 mol %.

The insulator 2 shown in FIG. 3A has the following dimensions. L1=ca.60 mm, L2=ca.8 mm, L3=ca.14 mm, D1=ca.10 mm, D2=ca.13 mm, D3=ca.7 mm, D4=5.5 mm, D5=4.5 mm, D6=4 mm, D7=2.6 mm, t1=1.5 mm, t2=1.45 mm, t3=1.25 mm, and tA=1.35 mm. In FIG. 1, a length LQ of the portion 2*k* of the insulator 2 which projects over the rear end of the metal shell 1, is 25 mm. In a vertical cross section containing the center axial line O of the insulator 2 on the outer contour of the projecting portion 2*k* of the insulator 2, the length LP of the portion 2*k* as measured along the profile of the insulator 2 is 29 mm, starting from a position corresponding to the rear end of the metal shell 1, through the surface of the corrugations 2*c*, to the rear end of the insulator 2.

The glaze slurry was prepared as follows.

$SiO_2$ powder (purity: 99.5%), $H_3BO_3$powder (purity: 98.5%), ZnO powder (purity: 99.5%), $BaSO_4$ powder (purity: 99.5%), $SrCO_3$ powder (purity: 99%), $Na_2CO_3$ powder (purity: 99.5%), $K_2CO_3$powder (purity: 99%), $Li_2CO_3$ powder (purity: 99%) $Al_2O_3$ powder (purity: 99.5%), $MoO_3$powder (purity: 99%), $ZrO_2$ powder (purity: 99.5%), CaO powder (purity: 99.5%), MgO powder (purity; 99.5%), $TiO_2$ powder (purity: 99.5%), $Bi_2O_3$ powder (purity: 99%), $SnO_Z$ powder (purity; 99.5%), $Sb_2O_5$ powder (purity: 99%), and $P_2O_5$ powder (purity: 99%) were mixed. The mixture was melted 1000 to 1500° C., and the melt was poured into the water and rapidly cooled for vitrification, followed by grinding in an alumina pot mill to powder of 50 μm or smaller. Three parts by weight of New Zealand kaolin and 2 parts by weight of PVA as an organic binder were mixed into 100 parts by weight of the glaze powder, and the mixture was kneaded with 100 parts by weight of the water to prepare the glaze slurry.

The glaze slurry was sprayed on the insulator 2 from the spray nozzle as illustrated in FIG. 7, and dried to form the coated layer 2*d*' of the glaze slurry having a coated thickness of about 100 μm. Several kinds of the spark plug 100 were produced by using the insulator 2 through the process explained with reference to FIGS. 8 and 9. The outer diameter of the thread 7 was 14 mm. The resistor 15 was made of the mixed powder consisting of $B_2O_3$—$SiO_2$—BaO—$LiO_2$ glass powder, $ZrO_Z$ powder, carbon black powder, $TiO_2$ powder, and metallic Al powder. The electrically conductive glass seal layers 16, 17 were made of the mixed powder consisting of $B_2O_3$—$SiO_2$—$Na_2O$ glass powder, Cu powder, Fe powder, and Fe—B powder. The heating temperature for the glass sealing, i.e., the glaze baking temperature was set at 900° C. The thickness of the glazing layer 2*d* formed on the surface of each insulator 2 was about 20 μm.

On the other hand, such glaze samples were produced which were not pulverized but solidified in block. The block-like sample was confirmed by the X-ray diffraction to be a vitrified (amorphous) state.

The experiments were performed as follows.

(1) Chemical Composition Analysis

The X-ray fluorescence analysis was conducted. The analyzed value per each sample (in terms of oxide) was shown in Tables 1 to 4. The analytical results obtained by EPMA on the glaze layer 2*d* formed on the insulator were almost in agreement with the results measured with the block-like samples.

(2) Thermal Expansion Coefficient

The specimen of 5 mm×5 mm×5 mm was cut out from the block-like sample, and measured with the known dilatometer method at the temperature ranging 20 to 350° C. The same measurement was made at the same size of the specimen cut out from the insulator 2. As a result, the value was $73\times10^{-7}$/° C.

(3) Softening Point

The powder sample weighing 50 mg was subjected to the differential thermal analysis, and the heating was measured from a room temperature. The second endothermic peak was taken as the softening point.

With respect to the respective spark plugs, the insulation resistance at 500° C. was evaluated at the applied voltage 1000V through the process explained with reference to FIG. 6. Further, the appearance of the glaze layer 2*d* formed on the insulator 2 was visually observed. The above mentioned results are shown in Tables 1 to 4.

TABLE 1

| | 1 | 2 | 3 | 4 | 5 | 6* | 7* |
|---|---|---|---|---|---|---|---|
| Com. (mol %) | | | | | | | |
| $SiO_2$ | 43.0 | 43.0 | 43.0 | 43.0 | 43.0 | 41.0 | 38.0 |
| $B_2O_3$ | 25.0 | 25.0 | 25.0 | 25.0 | 25.0 | 25.0 | 22.0 |
| ZnO | 11.0 | 11.0 | 11.0 | 11.0 | 11.0 | 15.0 | 16.0 |
| BaO | 7.0 | — | 3.5 | 3.5 | 3.5 | 9.0 | 7.0 |
| SrO | — | 7.0 | — | — | 3.5 | — | — |
| $Na_2O$ | 2.5 | 2.5 | 2.5 | 2.5 | 2.5 | 2.0 | 4.0 |

TABLE 1-continued

| | 1 | 2 | 3 | 4 | 5 | 6* | 7* |
|---|---|---|---|---|---|---|---|
| $K_2O$ | 4.0 | 4.0 | 4.0 | 4.0 | 4.0 | 3.0 | 8.0 |
| $Li_2O$ | 4.5 | 4.5 | 4.5 | 4.5 | 4.5 | 3.0 | 5.0 |
| $Al_2O_3$ | 3.0 | 3.0 | 3.0 | 3.0 | 3.0 | 1.0 | — |
| $MoO_3$ | — | — | — | — | — | — | — |
| $ZrO_2$ | — | — | — | — | — | 1.0 | — |
| CaO | — | — | 3.5 | — | — | — | — |
| MgO | — | — | — | 3.5 | — | — | — |
| $TiO_2$ | — | — | — | — | — | — | — |
| $Bi_2O_3$ | — | — | — | — | — | — | — |
| $SnO_2$ | — | — | — | — | — | — | — |
| $Sb_2O_5$ | — | — | — | — | — | — | — |
| $P_2O_5$ | — | — | — | — | — | — | — |
| Total | 100 | 100 | 100 | 100 | 100 | 100 | 100 |
| $R_2O$ | 11.0 | 11.0 | 11.0 | 11.0 | 11.0 | 8.0 | 17.0 |
| K/(Na + K + Li) | 0.36 | 0.36 | 0.36 | 0.36 | 0.36 | 0.38 | 0.47 |
| Li/(Na + K + Li) | 0.41 | 0.41 | 0.41 | 0.41 | 0.41 | 0.38 | 0.29 |
| ZnO + BaO and/or SrO | 18.0 | 18.0 | 14.5 | 14.5 | 18.0 | 24.0 | 23.0 |
| $(B_2O_3 + ZnO)/(REO + R_2O)$ | 2.00 | 2.00 | 2.00 | 2.00 | 2.00 | 2.35 | 1.58 |
| Softening point (° C.) | 650 | 650 | 660 | 660 | 650 | 680 | 600 |
| Coefficient of thermal expansion × 10 − 7 | 70.0 | 69.0 | 68.0 | 68.0 | 70.0 | 45.0 | 85.0 |
| Insulation resistance at 500° C. (MΩ) | 1000 | 1000 | 1000 | 1000 | 1000 | 1800 | 100 |
| Appearance | Good | Good | Good | Good | Good | Glaze crimp-ing | Good |

Com.: Composition
*shows "outside" of the invention.

TABLE 2

| | 8* | 9 | 10 | 11* | 12* | 13* | 14 |
|---|---|---|---|---|---|---|---|
| Com. (mol %) | | | | | | | |
| $SiO_2$ | 43.0 | 54.0 | 36.0 | 60.0 | 30.0 | 36.0 | 39.0 |
| $B_2O_3$ | 20.0 | 21.0 | 30.0 | 18.0 | 33.0 | 40.0 | 26.5 |
| ZnO | 11.0 | 6.0 | 12.0 | 6.0 | 11.0 | 8.0 | 11.0 |
| BaO | 9.0 | 7.0 | 7.0 | 5.0 | 10.0 | 4.0 | 7.0 |
| SrO | — | — | — | — | — | — | — |
| $Na_2O$ | 4.0 | 2.5 | 2.5 | 2.5 | 2.5 | 2.5 | 6.0 |
| $K_2O$ | 8.0 | 4.0 | 4.0 | 4.0 | 4.0 | 4.0 | 4.0 |
| $Li_2O$ | 5.0 | 4.5 | 4.5 | 4.5 | 4.5 | 4.5 | 4.5 |
| $Al_2O_3$ | — | — | 2.0 | — | 3.0 | 1.0 | 1.0 |
| $MoO_3$ | — | — | 1.0 | — | 1.0 | — | — |
| $ZrO_2$ | — | 1.0 | 1.0 | — | 1.0 | — | 1.0 |
| CaO | — | — | — | — | — | — | — |
| MgO | — | — | — | — | — | — | — |
| $TiO_2$ | — | — | — | — | — | — | — |
| $Bi_2O_3$ | — | — | — | — | — | — | — |
| $SnO_2$ | — | — | — | — | — | — | — |
| $Sb_2O_5$ | — | — | — | — | — | — | — |
| $P_2O_5$ | — | — | — | — | — | — | — |
| Total | 100 | 100 | 100 | 100 | 100 | 100 | 100 |
| $R_2O$ | 17.0 | 11.0 | 11.0 | 11.0 | 11.0 | 11.0 | 14.5 |
| K/(Na + K + Li) | 0.47 | 0.36 | 0.36 | 0.36 | 0.36 | 0.36 | 0.28 |
| Li/(Na + K + Li) | 0.29 | 0.41 | 0.41 | 0.41 | 0.41 | 0.41 | 0.31 |
| ZnO + BaO and/or SrO | 20.0 | 13.0 | 19.0 | 11.0 | 21.0 | 12.0 | 18.0 |
| $(B_2O_3 + ZnO)/(REO + R_2O)$ | 1.19 | 1.50 | 2.33 | 1.50 | 2.10 | 3.20 | 1.74 |
| Meltening point (° C.) | 620 | 660 | 640 | 710 | 620 | 615 | 620 |

TABLE 2-continued

| | 8* | 9 | 10 | 11* | 12* | 13* | 14 |
|---|---|---|---|---|---|---|---|
| Coefficient of thermal expansion × 10 − 7 | 90.0 | 72.0 | 66.0 | 68.0 | 74.0 | 60.0 | 71.0 |
| Insulation resistance at 500° C. (MΩ) | 250 | 1200 | 800 | 1400 | 150 | 950 | 700 |
| Appearance | A | Good | Good | B | Good | Glaze crimp-ing | Good |

Com.: Composition
A: Crazing
B: Insufficient glaze-melting
*shows "outside" of the invention.

TABLE 3

| | 15 | 16 | 17 | 18 | 19 | 20 | 21 |
|---|---|---|---|---|---|---|---|
| Com. (mol %) | | | | | | | |
| $SiO_2$ | 39.0 | 37.0 | 37.0 | 37.0 | 37.0 | 37.0 | 39.0 |
| $B_2O_3$ | 26.5 | 28.5 | 28.5 | 28.5 | 28.5 | 28.5 | 26.5 |
| ZnO | 11.0 | 11.0 | 11.0 | 11.0 | 11.0 | 11.0 | 11.0 |
| BaO | 7.0 | 7.0 | 7.0 | 7.0 | 7.0 | 7.0 | 7.0 |
| SrO | — | — | — | — | — | — | — |
| $Na_2O$ | 3.0 | 3.0 | 3.0 | 3.0 | 3.0 | 3.0 | 7.0 |
| $K_2O$ | 7.0 | 7.0 | 7.0 | 7.0 | 7.0 | 7.0 | 5.0 |
| $Li_2O$ | 4.5 | 4.5 | 4.5 | 4.5 | 4.5 | 4.5 | 2.5 |
| $Al_2O_3$ | 1.0 | 1.0 | 1.0 | 1.0 | 1.0 | 1.0 | 1.0 |
| $MoO_3$ | — | — | — | — | — | — | — |
| $ZrO_2$ | 1.0 | — | — | — | — | — | 1.0 |
| CaO | — | — | — | — | — | — | — |
| MgO | — | — | — | — | — | — | — |
| $TiO_2$ | — | 1.0 | — | — | — | — | — |
| $Bi_2O_3$ | — | — | 1.0 | — | — | — | — |
| $SnO_2$ | — | — | — | 1.0 | — | — | — |
| $Sb_2O_5$ | — | — | — | — | 1.0 | — | — |
| $P_2O_5$ | — | — | — | — | — | 1.0 | — |
| Total | 100 | 100 | 100 | 100 | 100 | 100 | 100 |
| $R_2O$ | 14.5 | 14.5 | 14.5 | 14.5 | 14.5 | 14.5 | 14.5 |
| K/(Na + K + Li) | 0.48 | 0.48 | 0.48 | 0.48 | 0.48 | 0.48 | 0.34 |
| Li/(Na + K + Li) | 0.31 | 0.31 | 0.31 | 0.31 | 0.31 | 0.31 | 0.17 |
| ZnO + BaO and/or SrO | 18.0 | 18.0 | 18.0 | 18.0 | 18.0 | 18.0 | 18.0 |
| $(B_2O_3 + ZnO)/(REO + R_2O)$ | 1.74 | 1.84 | 1.84 | 1.84 | 1.84 | 1.84 | 1.74 |
| Softening point (° C.) | 625 | 625 | 610 | 620 | 615 | 620 | 620 |
| Coefficient of thermal expansion × 10 − 7 | 73.0 | 73.0 | 72.0 | 72.0 | 72.0 | 72.0 | 72.0 |
| Insulation resistance at 500° C. (MΩ) | 900 | 900 | 900 | 900 | 900 | 900 | 300 |
| Appearance | Good | Good | Good | Good | Good | Good | Small bub-bling |

Com.: Composition

TABLE 4

| | 22 | 23 | 24 | 25 |
|---|---|---|---|---|
| Com. (mol %) | | | | |
| $SiO_2$ | 39.0 | 39.0 | 57.0 | 35.0 |
| $B_2O_3$ | 28.5 | 28.5 | 24.5 | 18.0 |
| ZnO | 11.0 | 11.0 | 3.0 | 17.0 |

TABLE 4-continued

| | 22 | 23 | 24 | 25 |
|---|---|---|---|---|
| BaO | 7.0 | 7.0 | 4.0 | 14.0 |
| SrO | — | — | — | — |
| $Na_2O$ | 1.0 | 1.0 | 2.5 | 4.0 |
| $K_2O$ | 13.5 | 5.5 | 4.0 | 5.0 |
| $Li_2O$ | — | 8.0 | 4.5 | 5.0 |

TABLE 4-continued

| | 22 | 23 | 24 | 25 |
|---|---|---|---|---|
| $Al_2O_3$ | — | — | — | 1.0 |
| $MoO_3$ | — | — | — | — |
| $ZrO_2$ | — | — | 1.0 | 1.0 |
| CaO | — | — | — | — |
| MgO | — | — | — | — |
| $TiO_2$ | — | — | — | — |
| $Bi_2O_3$ | — | — | — | — |
| $SnO_2$ | — | — | — | — |
| $Sb_2O_5$ | — | — | — | — |
| $P_2O_5$ | — | — | — | — |
| Total | 100 | 100 | 100 | 100 |
| $R_2O$ | 14.5 | 14.5 | 11.0 | 14.0 |
| K/(Na + K + Li) | 0.93 | 0.38 | 0.36 | 0.36 |
| Li/(Na + K + Li) | 0.00 | 0.55 | 0.41 | 0.36 |
| ZnO + BaO and/or SrO | 18.0 | 18.0 | 7.0 | 31.0 |
| $(BzO_3 + ZnO)/(REO + R_2O)$ | 1.84 | 1.84 | 1.80 | 1.25 |
| Softening point (° C.) | 640 | 615 | 650 | 620 |
| Coefficient of thermal expansion $\times 10^{-7}$ | 78.0 | 70.0 | 68.0 | 74.0 |
| Insulation resistance at 500° C. (MΩ) | 1800 | 500 | 600 | 700 |
| Appearance | Small bubbles remain | Small crimping | C | Slight opacity |

Com.: Composition
C: Slightly insufficient melting

According to the results, depending on the compositions of the glaze of the invention, Pb is scarcely contained, and although the alkaline metal components are contained enough to provide the fluidity when baking the glaze, sufficient insulating properties are secured, and the external appearance of the baked glaze faces are almost satisfied.

The entire disclosure of each and every foreign patent application from which the benefit of foreign priority has been claimed in the present application is incorporated herein by reference, as if fully set forth herein.

I claim:

1. A spark plug comprising:

a central electrode;

a metal shell;

an alumina ceramic insulator disposed between the center electrode and the metal shell, wherein at least part of the surface of the insulator is covered with a glaze layer comprising oxides, wherein the glaze layer comprises:

1 mol % or less of a Pb component in terms of PbO;

35 to 55 mol % of a Si component in terms of $SiO_2$;

15 to 35 mol % of a B component in terms of $B_2O_3$;

5 to 20 mol % of a Zn component in terms of ZnO;

0.5 to 20 mol % in total of at least one of Ba and Sr components in terms of BaO and SrO, respectively; and 11 to 15 mol % in total of alkaline metal components Na, K, and Li in terms of $Na_2O$, $K_2O$, and $Li_2O$, respectively;

wherein the glaze layer contains Li, Na and K components, and satisfies the relationship: $0.2<NLi_2O/NR_2O<0.5$ when the alkaline metal components are taken as R, $NR_2O$ is a total mol content of the alkaline metals in terms of a composition formula $R_2O$, and $NLi_2O$ is a mol content of the Li component in terms of $Li_2O$.

2. A spark plug comprising:

a central electrode;

a metal shell;

an alumina ceramic insulator disposed between the center electrode and the metal shell, wherein at least part of the surface of the insulator is covered with a glaze layer comprising oxides, wherein the glaze layer comprises:

1 mol % or less of a Pb component in terms of PbO;

35 to 55 mol % of a Si component in terms of $SiO_2$;

15 to 35 mol % of a B component in terms of $B_2O_3$;

5 to 20 mol % of a Zn component in terms of ZnO; 0.5 to 20 mol % in total of at least one of Ba and Sr components in terms f BaG and SrO, respectively; and 11 to 15 mol % in total of alkaline metal components Na, K, and Li in terms of $Na_2O$, $K_2O$, and $Li_2O$, respectively;

wherein the glaze layer contains Li, Na and K components, and satisfies the relationship: $4<NK_2O/NR_2O<0.8$ when the alkaline metal components are taken as R, $NR_2O$ is a total mol content of the alkaline metals in terms of a composition formula $R_2O$, and $NK_2O$ is a mol content of the K component in terms of $K_2O$.

3. The spark plug according to claim 1, wherein the glaze layer further comprises a B component and a Zn component in terms of $B_2O_3$ and ZnO, respectively, in a total mol amount of $N(B_2O_3+ZnO)$, the glaze layer further comprises at least one of: an alkaline earth metal component RE, RE being at least one selected from Ba, Mg, Ca and Sr, in terms of a composition formula REO; and an alkaline metal component R, R including Na, K and Li, in terms of a composition formula $R_2O$, in a total mol amount of $N(REO+R_2O)$, and the ratio: $N(B_2O_3+ZnO)/N(REO+R_2O)$ is 1.5 to 3.0.

4. The spark plug according to claim 1, wherein the glaze layer contains 8 to 30 mol % in total of the Zn component and the at least one of Ba and Sr components in terms of ZnO, BaQ and SrO, respectively.

5. The spark plug according to claim 1, wherein the glaze layer further comprises 0.5 to 5 mol % in total of at least one of Zr, Ti, Mg, Bi, Sn, Sb and P terms of $ZrO_2$, $TiO_2$, MgO, $Bi_2O_3$, $SnO_2$, $Sb_2O_5$ and $P_2O_5$, respectively.

6. The spark plug according to claim 1, which compromises one of: a terminal metal fixture and the center electrode as one body, in a through hole of the insulator; and a terminal metal fixture provided separately from the center electrode via a conductive bonding layer, in a through hole of the insulator, and an insulation resistant value is 200 MΩ or more, which is measured by keeping the whole of the spark plug at about 500° C. and passing a current between the terminal met fixture and the metal shell via the insulator.

7. The spark plug according to claim 1, wherein the insulator comprises an alumina insulating material containing 85 to 98 mol % of an Al component in terms of $Al_2O_3$, and the glaze layer has an average thermal expansion coefficient at the temperature ranging 20 to 350° C. of $5\times10^{-6}$/° C. to $8.5\times10^{-6}$/° C.

8. The spark plug according to claim 1, wherein the glaze layer has a softening point of 600 to 700° C.

* * * * *